US010998146B2

(12) United States Patent
Lehmann

(10) Patent No.: US 10,998,146 B2
(45) Date of Patent: May 4, 2021

(54) TOGGLE LEVER CONNECTION FOR ELECTRIC SWITCHES

(71) Applicant: Siemens Aktiengesellschaft, Munich (DE)

(72) Inventor: Stephan Lehmann, Hahnbach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 16/775,320

(22) Filed: Jan. 29, 2020

(65) Prior Publication Data

US 2020/0243272 A1 Jul. 30, 2020

(30) Foreign Application Priority Data

Jan. 30, 2019 (DE) ..... 10 2019 201 179.9

(51) Int. Cl.
*H01H 9/28* (2006.01)
*H01H 9/26* (2006.01)
*H01H 21/22* (2006.01)

(52) U.S. Cl.
CPC ..... *H01H 9/26* (2013.01); *H01H 21/22* (2013.01); *H01H 2009/265* (2013.01); *H01H 2221/052* (2013.01)

(58) Field of Classification Search
CPC ..... H01H 9/28; H01H 9/286; H01H 9/287; H01H 2300/024; H01H 9/282; H01H 9/283; H01H 9/20; H01H 9/281; H01H 9/26; H01H 21/22; H01H 2009/265; H01H 2221/052; H01H 71/521; H01H 71/1018
See application file for complete search history.

(56) References Cited

U.S. PATENT DOCUMENTS 5,905,236 A * 5/1999 Green ..... H01H 9/283 200/43.14
6,861,596 B2 * 3/2005 Schnackenberg ..... H01H 9/26 200/43.01
7,238,898 B1 * 7/2007 Czarnecki ..... H01H 9/161 200/50.01

(Continued)

FOREIGN PATENT DOCUMENTS

DE 2855040 A1 7/1979
DE 102007043253 B4 4/2014
EP 2234139 A1 9/2010

OTHER PUBLICATIONS

German Office Action dated Sep. 27, 2019.

*Primary Examiner* — Ahmed M Saeed

(74) *Attorney, Agent, or Firm* — Harness, Dickey & Pierce, P.L.C.

(57) ABSTRACT

A toggle lever connection for connecting at least two toggle levers is disclosed. The toggle levers each include two grooves arranged opposite each other. The toggle lever connection includes a frame and a slider with one hook per toggle lever. The frame and the slider run into each other and can be displaced in relation to each other between a first, open position, in which the toggle lever connection can be placed onto the at least two toggle levers or removed therefrom, and a second, closed position, in which the hooks grip into the grooves of the at least two toggle levers, thereby locking the toggle lever connection to the toggle levers.

12 Claims, 7 Drawing Sheets

(56) References Cited

U.S. PATENT DOCUMENTS

2014/0166448 A1* 6/2014 Krieger ..... H01H 9/282
200/43.15
2014/0318933 A1* 10/2014 Yang ..... H01H 9/20
200/43.14

* cited by examiner

TOGGLE LEVER CONNECTION FOR ELECTRIC SWITCHES

PRIORITY STATEMENT

The present application hereby claims priority under 35 U.S.C. § 119 to German patent application number DE 102019201179.9 filed Jan. 30, 2019, the entire contents of which are hereby incorporated herein by reference.

FIELD

At least one embodiment of the invention generally relates to a toggle lever connection for connecting at least two toggle levers of electric switches and to a system with such a toggle lever connection.

BACKGROUND

Electric switches, for example circuit breakers, can be switched via a toggle lever. The toggle levers can be actuated electromechanically, for example via a motor operator, or manually by an operator.

In a system including a plurality of electric switches, it may be necessary for the switches to be actuated simultaneously. It may also be desirable for the toggle levers of the plurality of electric switches to be designed to be blockable in order to prevent inadvertent switching. It is advantageous in this case if the connecting part for the toggle levers can be mounted and can be installed retrospectively on electric switches which have already been installed.

In previous solutions, a connecting part is placed onto a central electric switch and then the adjacent electric switches are connected to the connecting part. The ensemble of electric switches can then be fitted in the switchgear cabinet and hooked up. Such a solution is very awkward to assemble; the entire ensemble of electric switches always has to be removed from the switchgear cabinet in order to exchange a switch.

Another known solution uses a connecting part which can be plugged on, wherein the connection is undertaken via a continuous rivet which is deformed after the assembly. Disassembly of such a construction is no longer possible. If, instead of the rivet, use is made of a shaft or a screw, the latter can also be spatially difficult to disassemble.

SUMMARY

The inventors have therefore discovered that there is a need to provide an alternative connection of toggle levers of electric switches that overcomes the disadvantages described.

At least one embodiment of the invention is directed to a toggle lever connection. Advantageous refinements of the toggle lever connection are specified in the claims. At least one embodiment of the invention is directed to a system. Advantageous refinements of the system according to the invention are specified in the claims.

The toggle lever connection for connecting at least two toggle levers, wherein the toggle levers comprise two grooves arranged opposite each other, in at least one embodiment, comprises a frame and a slider with one hook per toggle lever, wherein the frame and the slider run into each other and can be displaced in relation to each other between a first, open position, in which the toggle lever connection can be placed onto the at least two toggle levers or removed therefrom, and a second, closed position, in which the hooks grip into the grooves of the at least two toggle levers, thereby locking the toggle lever connection to the toggle levers.

The system of at least one embodiment comprises a toggle lever connection according to the invention and, in addition, a locking frame, wherein the locking frame can be placed onto an electric switch having a toggle lever and ensures that the toggle lever connection can be placed thereon only in the OFF position of the toggle lever.

BRIEF DESCRIPTION OF THE DRAWINGS

The above-described properties, features and advantages of this invention, and the manner in which they are achieved, will become clearer and more clearly comprehensible in conjunction with the description below of the example embodiments which will be explained in more detail in conjunction with the figures, in which.

DETAILED DESCRIPTION OF EXAMPLE EMBODIMENTS

Figure 1:
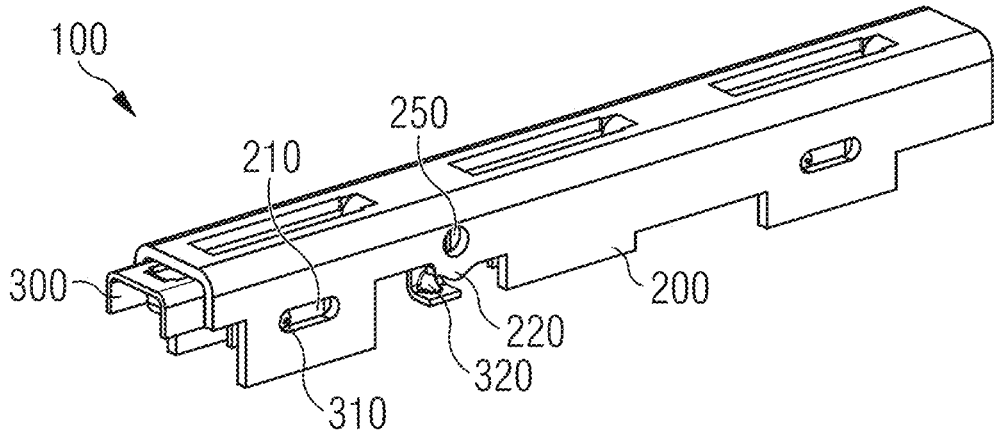
FIG. 1 shows a toggle lever connection with frame and slider.

In the following, embodiments of the invention are described in detail with reference to the accompanying drawings. It is to be understood that the following description of the embodiments is given only for the purpose of illustration and is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

The drawings are to be regarded as being schematic representations and elements illustrated in the drawings are not necessarily shown to scale. Rather, the various elements are represented such that their function and general purpose become apparent to a person skilled in the art. Any connection or coupling between functional blocks, devices, components, or other physical or functional units shown in the drawings or described herein may also be implemented by an indirect connection or coupling. A coupling between components may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "exemplary" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

The toggle lever connection for connecting at least two toggle levers, wherein the toggle levers comprise two grooves arranged opposite each other, in at least one embodiment, comprises a frame and a slider with one hook per toggle lever, wherein the frame and the slider run into each other and can be displaced in relation to each other between a first, open position, in which the toggle lever connection can be placed onto the at least two toggle levers or removed therefrom, and a second, closed position, in which the hooks grip into the grooves of the at least two toggle levers, thereby locking the toggle lever connection to the toggle levers.

An advantage here is that an operator can assemble and install the toggle lever connection according to the invention retrospectively on electric switches which have already been fitted. The toggle lever connection according to the invention is also releasable and can therefore be disassembled when required from all of the connected electric switches without the toggle lever connection having to be destroyed. Another advantage is that the displacement of frame and slider causes the toggle lever connection to hook onto all of the toggle levers and not only onto just a few elements of the connected toggle levers. A further advantage is that the hooks of frame and slider surround the respective toggle levers from two sides.

In one refinement of the toggle lever connection, during the transfer from the first position into the second position, the hooks of the frame and of the slider are moved toward one another such that the hooks surround the grooves of the toggle levers in the second, closed position. By way of the surrounding of the toggle levers, a particularly stable connection is provided between toggle lever connection and the individual toggle levers of the electric switches.

In a further refinement, the movement of frame and slider is limited by an embossment or a protrusion in a part which runs in an elongated hole in the other part. The end positions of the elongated hole, which end positions correspond to the first position and the second position, can be enforced via a clip on one part and via a slope on the other part, and therefore the toggle lever connection cannot come stably to rest in a position between the end positions.

In a further refinement, the frame and the slider comprise bores which overlap each other in the second, closed position, and therefore a screw or another fastening means or locking element can fix the toggle lever connection in the position.

The system of at least one embodiment comprises a toggle lever connection according to the invention and, in addition, a locking frame, wherein the locking frame can be placed onto an electric switch having a toggle lever and ensures that the toggle lever connection can be placed thereon only in the OFF position of the toggle lever.

In one refinement of the system, the latter furthermore comprises a first electric switch having a first toggle lever, a second electric switch having a second toggle lever, and a locking frame, wherein the locking frame is mounted on one of the electric switches and prevents the toggle lever connection from being able to be placed thereon if the toggle lever of the electric switch with the locking frame is not in the OFF position.

In a further refinement of the system, the locking frame comprises holes for the hooking in of a blocking element, such as a padlock, as a result of which the toggle lever connection cannot be moved past the blocking element and therefore cannot be moved away from its current position.

Figure 2A:
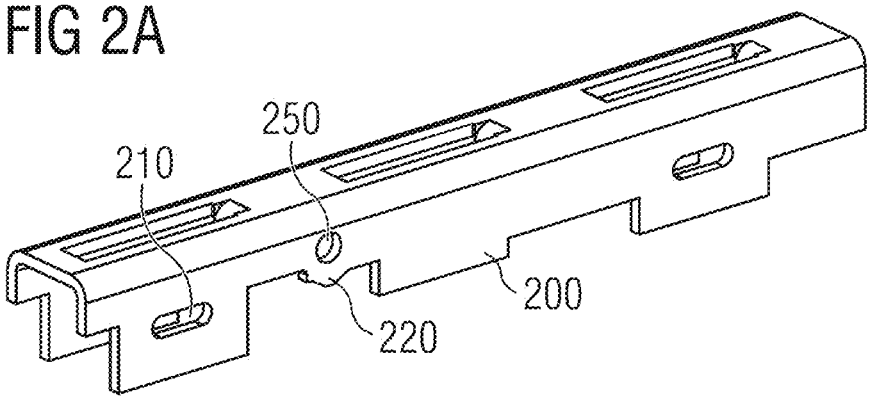
FIGS. 2A and 2B show frame and slider.
Figure 2B:
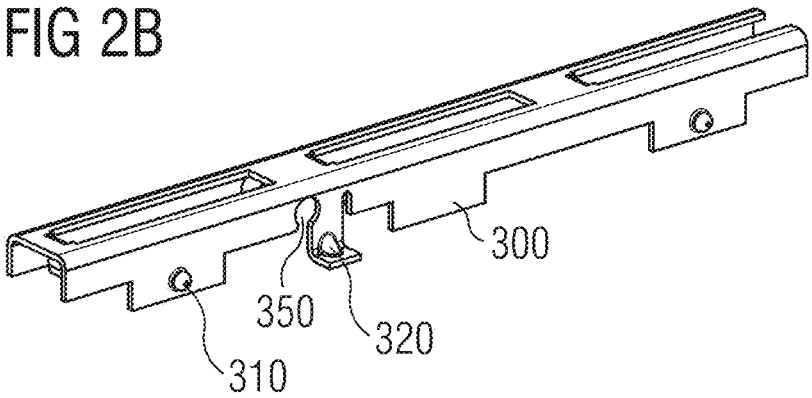

FIG. 1 illustrates a toggle lever connection 100 according to the invention. The toggle lever connection 100 comprises a frame 200 and a slider 300, wherein the frame 200 and the slider 300 run into each other and can be displaced in relation to each other. FIG. 2A shows the frame 200 in more detail, FIG. 2B shows the slider 300.

Figure 8A:
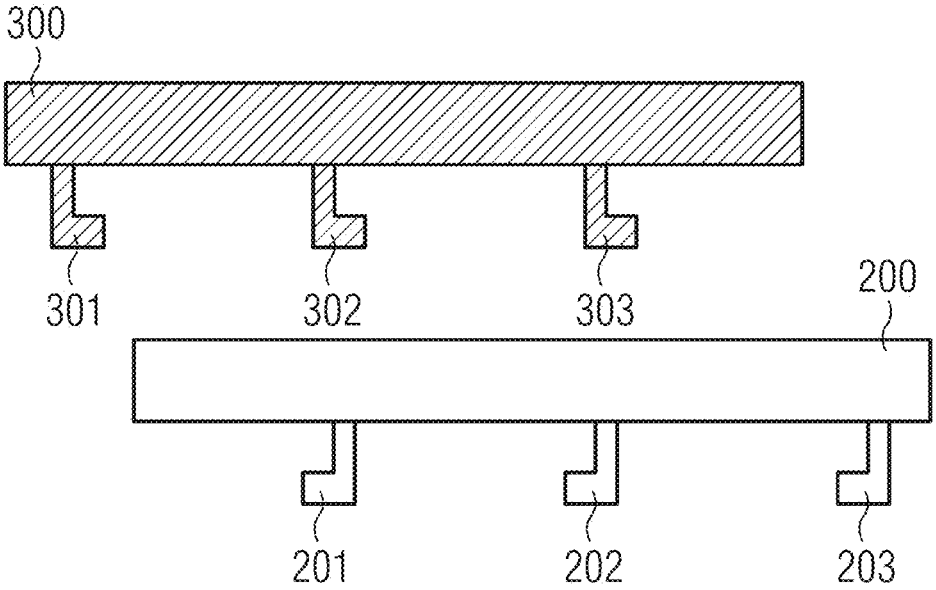
FIGS. 8A and 8B show the toggle lever connection with frame and slider with in each case hook and toggle lever connection in the first, open position.

Hooks 201, 202, 203; 301, 302, 303 are in each case attached to the frame 200 and to the slider 300. This is shown in more detail in FIG. 8A. The hooks 301, 302, 303 are attached to the slider 300 and the hooks 201, 202, 203 are attached to the frame 200.

If the frame 200 and the slider 300 now run into each other and are displaced in relation to each other, a first, open position is produced, in which the toggle lever connection can be placed onto at least two toggle levers or can be removed therefrom, and a second, closed position, in which the hooks 201, 202, 203; 301, 302, 303 grip into grooves 511; 512 of the at least two toggle levers and, as a result, the toggle lever connection 100 locks to the toggle levers.

Figure 8B:
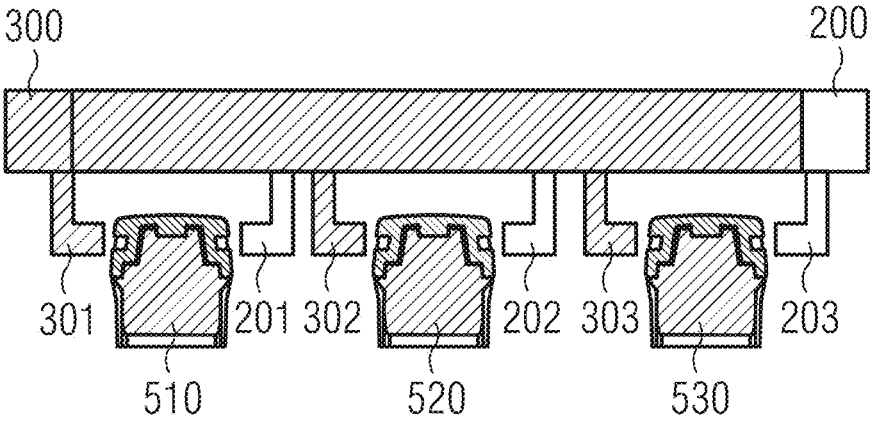

The first, open position is illustrated in FIG. 8B. The hooks 201, 202, 203 of the frame 200 are opposite the hooks 301, 302, 303 of the slider 300. If the slider 300 is now moved into the second, closed position, to the right according to the illustration of FIG. 8B, the hooks 201, 202, 203; 301, 302, 303 surround the toggle levers 510; 520; 530.

Figure 3A:
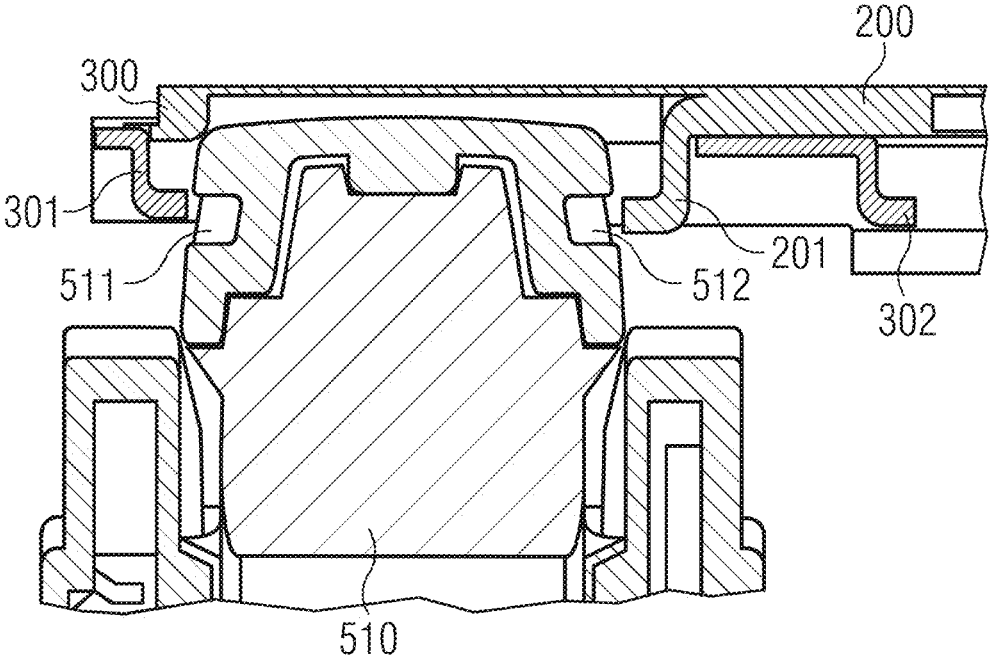
FIGS. 3A and 3B show the toggle lever connection in the first, open position and in the second, closed position.
Figure 3B:
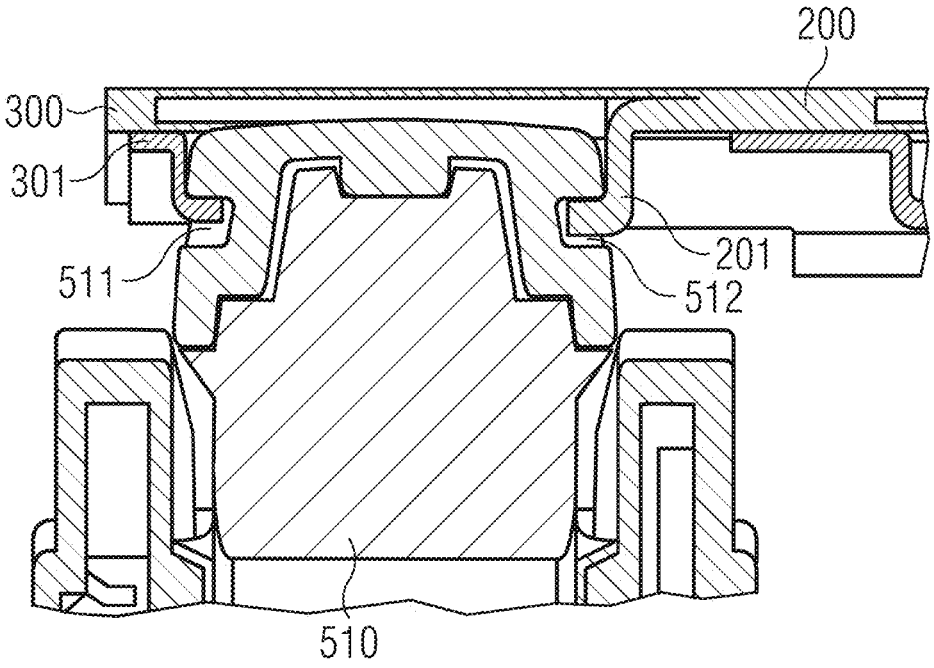

The first, open position and the second, closed position are illustrated in more detail in FIGS. 3A and 3B.

FIG. 3A shows the toggle lever connection 100 in the first, open position. For example for toggle lever 510, this means that the hook 201 of the frame 200 is level with the groove 512 of the toggle lever 510, and the hook 301 of the frame 300 is level with the groove 511.

If the toggle lever connection 100 is now transferred from the first, open position into the second, closed position, owing to the fact that the slider 300 is moved to the right according to the illustration of FIG. 3A and the hooks 201; 301 of the frame 200 and of the slider 300 are thereby moved toward one another, the hooks 201; 301 surround the grooves 511; 512, as illustrated in FIG. 3B.

The hooks 201; 301 grip into the grooves 511; 512, as a result of which the toggle lever connection 100 can be locked to the toggle lever 510 and cannot be removed therefrom. According to the illustration of FIG. 8B, this means, in the case of a plurality of toggle levers 510; 520; 530, that the toggle lever connection 100 cannot be removed in the second, closed position and the toggle levers 510; 520; 530 can only be actuated simultaneously.

The hooks 301, 302, 303 of the slider 300 each point in one direction and the hooks 201, 202, 203 of the frame 200 each point in the same other direction. According to the illustration of FIG. 8A, the hooks 201, 202, 203 of the frame 200 point to the left and the hooks 301, 302, 303 of the slider 300 point to the right. By displacement of slider 300 and frame 200 in relation to each other, the hooks 201, 202, 203; 301, 302, 303 are therefore moved toward one another when the toggle lever connection 100 is transferred from the first, open position into the second, closed position.

The frame 200 can be provided with an elongated hole 210 in which an embossment or a protrusion 310 of the slider 300 runs. The movement of frame 200 and slider 300 is thereby limited. This limitation is illustrated in more detail in FIGS. 4A and 4B.

Figure 4A:
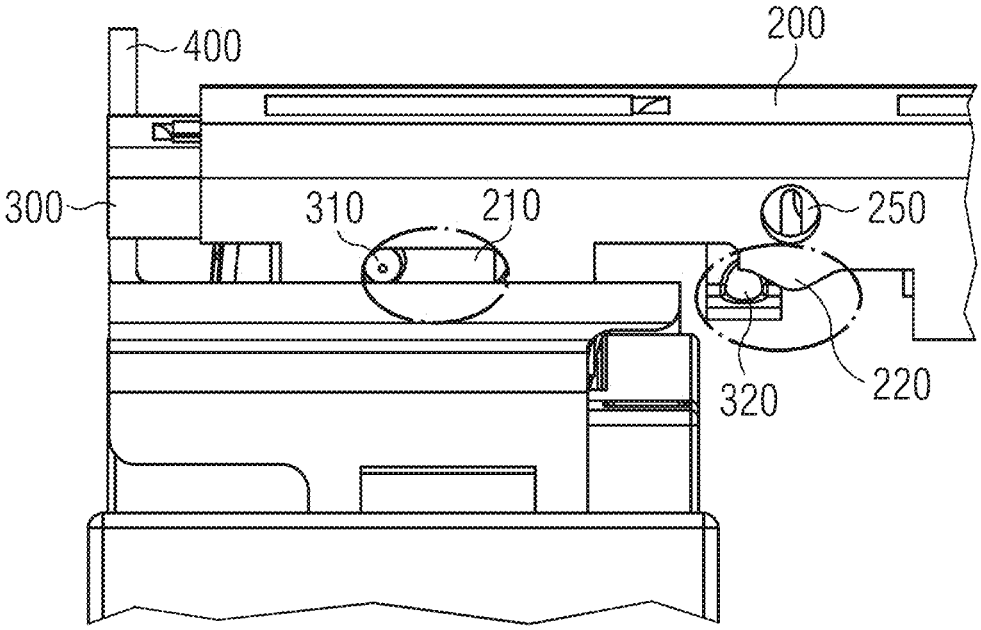
FIGS. 4A and 4B show the toggle lever connection in the first, open position with an embossment or protrusion and elongated hole and in the second, closed position with an embossment or protrusion and elongated hole.
Figure 4B:
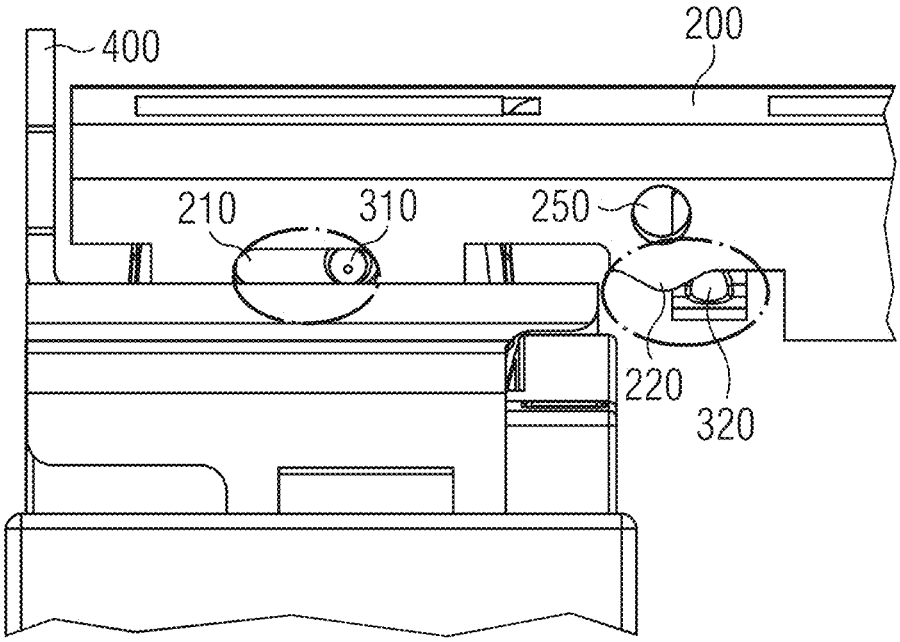

In FIG. 4A, the toggle lever connection 100 is located in the first, open position and the embossment or the protrusion 310 at the left end of the elongated hole 210, according to the illustration of FIG. 4A. FIG. 4B illustrates the second, closed position of the toggle lever connection 100. The embossment or the protrusion 310 is at the right end of the elongated hole 210 according to the illustration of FIG. 4B. A further movement beyond the positions is prevented or limited by the design of elongated hole 210 and embossment or protrusion 310.

In addition, the frame 200 can comprise a slope 220 and the slider 300 can comprise a clip 320. The slope 220 and clip 320 have the effect that the toggle lever connection 100 cannot come stably to rest in a position between the end positions. For example, during a movement from the first, open position according to the illustration of FIG. 4A into the second, closed position according to the illustration of FIG. 4B, the clip 320 has to overcome the slope 220 and, after reaching a central position, is pressed either into the first or into the second position.

Figure 7A:
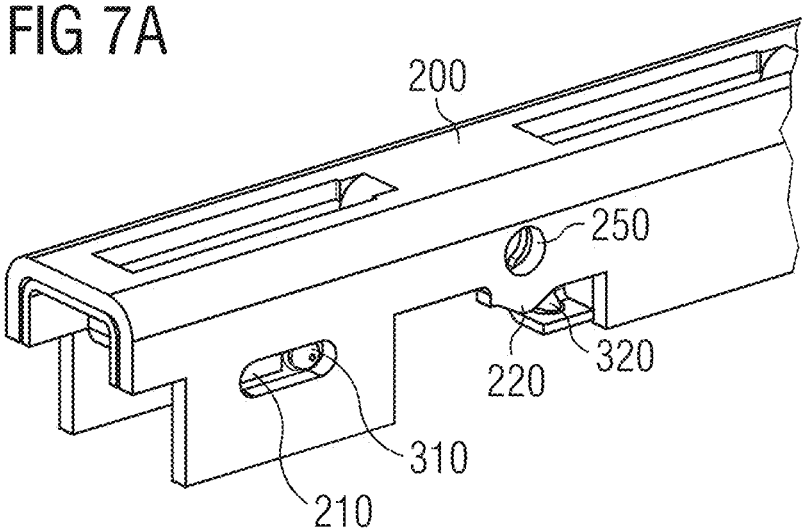
FIGS. 7A and 7B show the toggle lever connection with clip and slope.
Figure 7B:
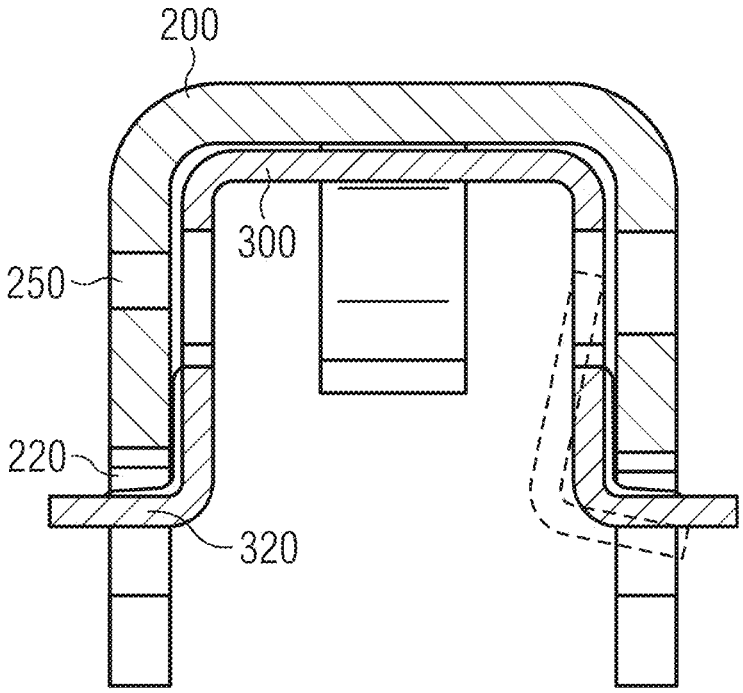

Slope 220 and clip 320 are also explained in more detail in FIGS. 7A and 7B. In order to overcome the maximum deflection of the slope 220, the clip 320 is pressed inward according to the illustration in FIG. 7B. Due to the spring force of the clip 320, the central position in the illustration of FIG. 7B is not stable, and the toggle lever connection 100 is transferred either into the first position or into the second position.

The frame 200 and the slider 300 can each contain bores 250; 350 which overlap each other in the second, closed position, and therefore a screw or another fastening means or locking element can fix the toggle lever connection 100 in this position.

Figure 5:
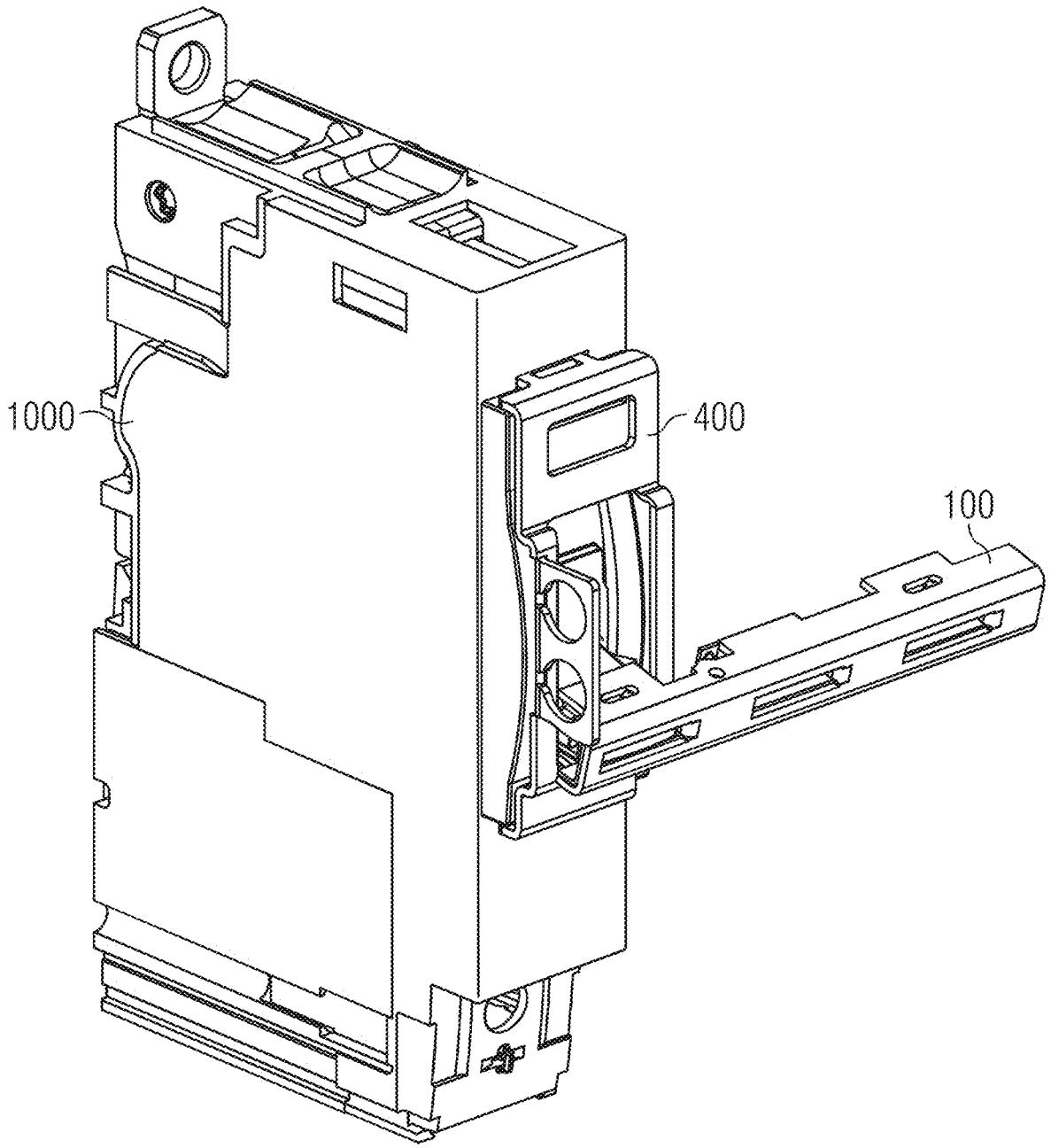
FIG. 5 shows an electric switch with locking frame and toggle lever connection.
Figure 6:
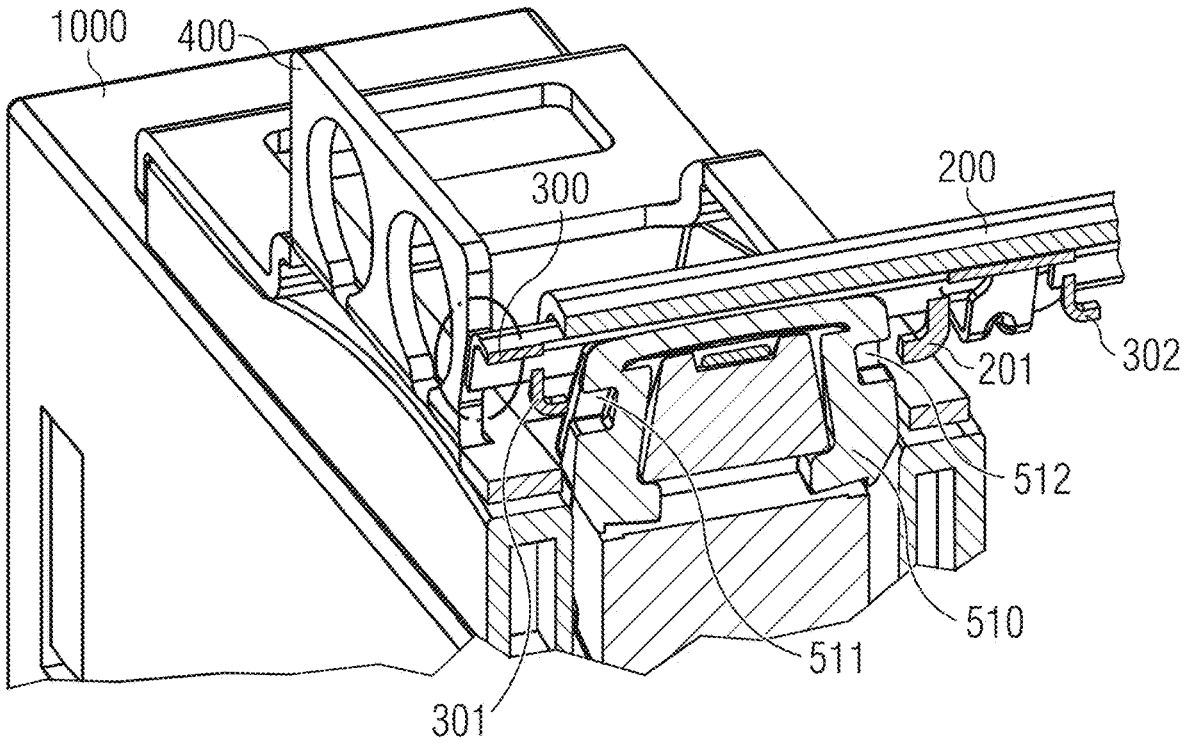
FIG. 6 shows an electric switch with locking frame and toggle lever connection in the first, open position.

Before the toggle lever connection 100 according to the invention is mounted on an electric switch 1000, what is referred to as a locking frame 400 can be mounted on the latter. The locking frame 400 is illustrated in FIGS. 5 and 6. The locking frame 400 prevents the toggle lever connection 100 from not being able to be placed thereon in a different position than the OFF position (electric switch 1000 switched off) of the toggle lever 510.

It is apparent from FIG. 6 that the slider 300 can be transferred into the open position only when the toggle lever 510 is in the OFF position. Otherwise, the slider 300 would come into mechanical contact with the locking frame 400 and would be obstructed in movement by the latter.

The locking frame 400 can comprise bores 401; 402 into which, for example, a padlock can be hooked, and therefore the toggle lever connection 100 cannot be moved out of a previously defined position.

The toggle lever connection 100 according to the invention provides a customer or operator with a retrospectively installable and re-releasable connection of toggle levers 510; 520; 530, in which not all of the electric switches 1000 have to be simultaneously assembled or disassembled for exchange purposes. The toggle levers 510; 520; 530 of the electric switches 1000 each have to have a groove 511; 512 into which the hooks 201, 202, 203; 301, 302, 303 of the frame 200 or of the slider 300 could fit. The toggle lever connection 100 according to the invention is plugged onto the toggle levers 510; 520; 530 by the grooves 511; 512. Frame 200 and slider 300 of the toggle lever connection 100 are configured to be displaceable in relation to each other.

In the installation position of the toggle lever connection 100, the first, open position, the hooks 201, 202, 203; 301, 302, 303 which are intended to engage in the grooves 511; 512 are at such a distance from each other that the installation takes place without force. After frame 200 and slider 300 are placed on, they are displaced in relation to each other and the hooks 201, 202, 203; 301, 302, 303 engage in the grooves 511; 512 of the toggle levers 510; 520; 530.

The two parts, frame 200 and slider 300, are plugged one into the other. The displaceability is ensured via an embossment or a protrusion 310 in an elongated hole 210. The two parts are displaced through a curved tab which is located on both sides of the slider 300 and can be formed on both sides. Beads are introduced into the bend of the tabs, the beads sliding past the contour of the outer frame and thereby ensuring two defined positions. Slope 220 and clamp 320 therefore ensure that the toggle lever connection 100 comes stably to rest only in the first, open position or the second, closed position. The clip 320 is bendable here. The clip 320 is bent inward by the movement of the toggle lever connection by the customer or operator, as far as the outer contour of the slope 220.

The frame 200 can be provided with a bore 250 and the slider 300 with a bore 350 which serve for the locking after the installation. Bores 250; 350 can also be introduced holes.

If a locking frame 400 is attached to the electric switch 1000, the toggle lever connection 100 according to the invention can be shut off in the selected switching state of the electric switch 1000. Should the customer not lock the toggle lever connection 100 (transfer it into the second, closed position), the electric switch cannot be switched on. Furthermore, installation of the toggle lever connection 100 is possible only in the switched-off state (OFF position) of the electric switch 1000.

The toggle lever connection 100 according to the invention makes it possible for the latter to be retrospectively mounted on, and also releasably attached to, electric switches 1000 which have already been fitted. If required, the toggle lever connection 100 can be released without all of the connected electric switches 1000 having to be disassembled or the toggle lever connection 100 having to be destroyed. By way of the displacement, the toggle lever connection 100 is hooked in onto all of the toggle levers 510; 520; 530 and is not only connected to certain toggle levers and also not only on one side of the toggle levers.

The toggle lever connection 100 according to the invention provides a latching function which ensures a first, open position and a second, closed position in a defined manner. Furthermore, after the closing, the toggle lever connection 100 can be secured in the second, closed state.

In the combination with a locking frame 400, the toggle lever connection 100 according to the invention can ensure that the toggle lever connection 100 is closed before it can be switched. Furthermore, the locking frame 400 provides the locking of the toggle levers 510; 520; 530 in the switch position selected by the customer.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35 U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A toggle lever connection for connecting at least two toggle levers, each of the at least two toggle levers including grooves arranged opposite each other, the toggle lever connection comprising:

a frame; and a slider, the slider including one hook for each toggle lever of the at least two toggle levers, wherein the frame and the slider intersect and each of the frame and the slider is displacable from each other, between a first, open position, in which the toggle lever connection is placeable onto the at least two toggle levers or removable from the at least two toggle levers, and a second, closed position, in which the hooks of the slider grip into the grooves of the at least two toggle levers, to lock the toggle lever connection to the at least two toggle levers; in which, during transfer from the first open position into the second closed position, hooks of the frame and the hooks of the slider being movable toward one another such that the hooks surround the grooves of the toggle levers in the second, closed position.

2. The toggle lever connection of claim 1, wherein the hooks of the frame and the hooks of the slider each point in a same direction.

3. The toggle lever connection of claim 1, wherein a movement of the frame and the slider is limited by an embossment or a protrusion in one of the frame or the slider which runs in an elongated hole in another of the slider and the frame.

4. The toggle lever connection of claim 3, wherein end positions of the elongated hole, the end positions corresponding to the first, open position and the second, closed position, are enforced via a clip on one of the frame and the slider and via a slope on the other of the slider and the frame, and wherein the toggle lever connection cannot come stably to rest in a position between the end positions.

5. The toggle lever connection of claim 1, wherein the frame and the slider each comprise bores which overlap each other in the second, closed position, and wherein a screw or another fastening device or locking element is configured to fix the toggle lever connection in the second, closed position.

6. A system, comprising:

the toggle lever connection of claim 1; and a locking frame, the locking frame being placeable onto an electric switch including a toggle lever and ensuring that the toggle lever connection is placeable thereon only in an OFF position of the toggle lever.

7. The system of claim 6, further comprising:

a first electric switch including a first toggle lever; and a second electric switch including a second toggle lever, wherein the locking frame is mounted on one of the first electric switch and the second electric switch and is configured to prevent the toggle lever connection from being placeable thereon if the first toggle lever or the second toggle lever, of the one of the first electric switch or the second electric switch upon which the locking frame is mounted, is not in the OFF position.

8. The system of claim 6, wherein the locking frame includes holes for hooking in of a blocking element, to prevent the toggle lever connection from being moved past the blocking element and moved away from its current position.

9. The toggle lever connection of claim 1, wherein the hooks of the frame and the hooks of the slider each point in a same direction.

10. The toggle lever connection of claim 2, wherein movement of frame and the slider is limited by an embossment or a protrusion in one of the frame or the slider which runs in an elongated hole in another of the slider and the frame.

11. The toggle lever connection of claim 10, wherein end positions of the elongated hole, the end positions corresponding to the first, open position and the second, closed position, are enforced via a clip on one of the frame and the slider and via a slope on the other of the slider and the frame, and wherein the toggle lever connection cannot come stably to rest in a position between the end positions.

12. The system of claim 7, wherein the locking frame includes holes for hooking in of a blocking element, to prevent the toggle lever connection from being moved past the blocking element and moved away from its current position.

* * * * *